US008515877B2

(12) United States Patent
Runstrom et al.

(10) Patent No.: US 8,515,877 B2
(45) Date of Patent: Aug. 20, 2013

(54) MAIL TRANSPORTATION PROCESSING

(75) Inventors: Erik Runstrom, Fort Collins, CO (US); Walter S. Conard, Lake Villa, IL (US)

(73) Assignee: Bell + Howell Company, Durham, NC (US)

( * ) Notice: Subject to any disclaimer, the term of this patent is extended or adjusted under 35 U.S.C. 154(b) by 43 days.

(21) Appl. No.: 12/478,010

(22) Filed: Jun. 4, 2009

(65) Prior Publication Data

US 2009/0313182 A1 Dec. 17, 2009

Related U.S. Application Data

(62) Division of application No. 11/709,847, filed on Feb. 23, 2007, now abandoned.

(60) Provisional application No. 60/877,647, filed on Dec. 29, 2006.

(51) Int. Cl.
*G07B 17/02* (2006.01)

(52) U.S. Cl.
USPC ..... 705/402

(58) Field of Classification Search
USPC ..... 705/402
See application file for complete search history.

(56) References Cited

U.S. PATENT DOCUMENTS

| | | | | |
|---|---|---|---|---|
| 5,329,102 | A * | 7/1994 | Sansone | 235/375 |
| 5,715,398 | A | 2/1998 | Lubenow et al. | |
| 7,062,473 | B1 * | 6/2006 | Taylor | 705/402 |
| 2002/0013744 | A1 * | 1/2002 | Tsunenari et al. | 705/28 |
| 2002/0032573 | A1 * | 3/2002 | Williams et al. | 705/1 |
| 2003/0033053 | A1 * | 2/2003 | Bodie | 700/221 |
| 2004/0030661 | A1 * | 2/2004 | Amato | 705/406 |
| 2004/0061272 | A1 | 4/2004 | Doery | |
| 2004/0133528 | A1 * | 7/2004 | Furka | 705/401 |
| 2005/0165704 | A1 * | 7/2005 | Lopez et al. | 705/410 |
| 2006/0173700 | A1 * | 8/2006 | Fenelon | 705/1 |
| 2007/0129957 | A1 | 6/2007 | Elliott et al. | |

OTHER PUBLICATIONS

Anonymous, "Direct Marketing Like No Other Company," High Volume Printing: HVP, Oct. 2003, 21, 5, pp. 50-53.*
United States Office Action issued in U.S. Appl. No. 11/709,847 dated Mar. 30, 2010.
United States Office Action issued in U.S. Appl. No. 11/709,847, mailed Jul. 8, 2010.
United States Office Action issued in U.S. Appl. No. 11/709,847, mailed Sep. 14, 2009.
United States Office Action issued in U.S. Appl. No. 11/709,847, mailed Feb. 18, 2011.

* cited by examiner

*Primary Examiner* — Nathan Erb
(74) *Attorney, Agent, or Firm* — McDermott Will & Emery LLP

(57) ABSTRACT

The present teachings described herein pertain to mail preparation systems, and more specifically to the processing of mailings to obtain destination entry discounts. The teachings herein also pertain to the processing of mailings by various document processing systems, such as sorters, inserters or vision systems attached to document processing systems, to enable processing of mail articles to maximize destination entry discounts. Still further, the teachings pertain to schemes for the enablement of delivery and logistics information to be arranged respective to a mailing during mail processing to obtain destination entry discounts.

15 Claims, 8 Drawing Sheets

MAIL TRANSPORTATION PROCESSING

RELATED APPLICATIONS

This application is a Divisional of U.S. Application No. 11/709,847, filed Feb. 23, 2007 now abandoned , claiming priority of U.S. Application No. 60/877,647, filed Dec. 29, 2006, the entire contents of each of which are hereby incorporated by reference.

TECHNICAL FIELD

The subject matter discussed herein relates to mail preparation methods and systems, and more particularly to the processing of mailings to obtain destination entry discounts.

BACKGROUND

In February, 1991, the US Postal Service (USPS) implemented postage discount incentives referred to as Destination Entry Discounts to mailers if they arranged for the transport of their finished & verified mailings (e.g., quantities of standard mail, periodicals, bound printed matter, parcel post) at their own expense to locations further downstream within the postal network. Numerous types and categories of mail can ultimately receive Destination Entry Discounts. Though the USPS currently emphasizes standard mail, these discounts can also be extended to first class mail including letters and flats plus small parcels and periodicals. Other classes and types of mail may receive different discount structures offered by other postal authorities and private posts. This grouping of mail types is generally referred to as business mail. Transporting business mail further downstream within the postal network requires delivery of the mailings to a destination entry, also referred to as a regional processing facility, as close as possible to the intended destination address. By enabling direct transport of verified business mail, hereafter referred to as "mail", by the mailer as opposed to the postal service, the number of destination entry stops between the mailer and the addressees is reduced. This in turn reduces the costs the USPS would normally incur for providing trucks, gas, man-hours, logistical maintenance, etc.

Generally, the USPS postal network includes a plurality of destination entries positioned throughout the United States in which the mail is processed as it is transported from the mailer to the addressee through the postal network. The various destination entries include Bulk Mail Centers (BMCs), Sectional Center Facilities (SCFs), Destination Delivery Units (DDUs) and Destination Area Distribution Centers [DADC] locations for mailings classified as periodicals. Each of these respective destination entries have a select level of presence within a given region of the US, and thus enables a select level of discount granularity, ranging from lowest discount granularity to highest.

To take advantage of the discount incentives, mailers typically employ drop shipping—an arrangement wherein mailings are consolidated and transported by a private carrier hired by the mailer to an applicable destination entry downstream. A lower discount is afforded a business mailing transported by the mailer to a BMC because there are fewer such facilities within a given region (e.g., a single BMC may serve one or more states), while the highest discount is afforded a mailing expressly transported to a DDU as these are more abundant and specific to a particular locale within a region (e.g., a neighborhood post office that serves a select number of ZIP Codes).

For a mailer to take advantage of such discounts in an efficient way, they must be able to easily group and package the mail in accord with an intended destination entry. Further, the mailer must be able to accurately pinpoint which destination entry or entries are applicable for discount purposes based on the makeup of their mailing, as well as determine the level of discounts applicable. Still further, the mailer must be able to coordinate delivery times appropriately, process USPS compliant forms, and ensure correct delivery of the mailing by the preferred carrier. Ultimately, the character or makeup of the mailing—relative mail piece weights, piece counts, delivery point designations, etc.—must be weighed against delivery options and destination entry criteria to properly ensure destination entry discounts. While various mail preparation software packages exist for preparing mailings in accord with postal authority rules, these packages provide limited tools for the preparation of destination entry discounts. Furthermore, these software packages do not feature integrated real-time logistic data access for enabling convenient drop ship preparation. Resultantly, the mailer must often employ ancillary tools and applications to perform such analysis, which requires additional data entry and processing steps to be performed. Nonetheless, even when in such cases, these ancillary/peripheral tools usually limit their analysis and/or destination entry depth to a single destination entry (e.g., BMC), and therefore limits the granularity of discount available based on the mailing.

SUMMARY

One aspect presented herein relates to a method for processing a mailing that includes a plurality of mail articles with respect to destination entry discounts. The method includes deriving mail makeup information associated with the mailing, wherein the mail makeup information includes at least address data related to each of the plurality of mail articles. One or more destination entry locations associated with the plurality of mail articles is determined based on the mail makeup information. A value of destination entry discounts associated with the plurality of mail articles is estimated based at least in part upon the one or more destination entry locations. In response to the determination of the one or more destination entry discounts, delivery carrier information associated with the mailing is obtained. The delivery carrier information includes at least a cost of transport of one or more of the plurality of mail articles to each destination entry location. The difference between the cost of transport and the estimated value of destination entry discounts associated with one or more of the plurality of mail articles represents one or more net cost savings opportunities.

It is also desirable to provide a system for processing a mailing with respect to destination entry discounts. The mailing is representative of a plurality of mail articles. The system includes a network and a processing system for providing mail makeup information for conveying at least address data related to the plurality of mail articles. A logistics engine is included for estimating a value of destination entry discounts associated with the plurality of mail articles based at least in part on the address data. A logistics service provider is included and capable of communicating with the logistics engine over the network. The logistics service provider generates delivery carrier information associated with one or more delivery service providers. The delivery carrier information includes at least a cost of transport of one or more of the plurality of mail articles to their respective destination entry location. The system also includes a user interface for conveying one or more net cost savings opportunities. The net cost savings opportunities are representative of the difference between the cost of transport and the estimated value of destination entry discounts associated with one or more of the plurality of mail articles.

In yet another aspect is a method for arranging transport of a plurality of mail articles with respect to destination entry discounts. The method includes displaying one or more net cost savings opportunities to a user by way of a user interface. The net cost savings opportunities are representative of a difference between a cost of transport of one or more of the plurality of mail articles to each destination entry location and an estimated value of destination entry discounts associated with one or more of the plurality of mail articles. The method further includes enabling selection by the user of one or more of the net cost savings opportunities and, in response to the selection, activating transport of one or more of the plurality of mail articles to each entry location. The transport is carried out by one or more delivery service providers upon which a cost of transport was determined.

It is also desirable to provide a method of processing a mailing including a plurality of mail articles. The method includes obtaining mail characteristic data from the mailing by at least one mail processing or generating device. One or more destination entry locations associated with the plurality of mail articles is determined based on the mail characteristic data. A value of destination entry discounts associated with the plurality of mail articles is estimated based at least in part upon the one or more destination entry locations. In response to the determination of the one or more destination entry discounts, delivery carrier information associated with the mailing is received. The delivery carrier information includes at least a cost of transporting one or more of the plurality of mail articles to each destination entry location.

Another aspect includes providing a method of processing a mailing including a plurality of mail articles. The method includes providing address data associated with the mailing. The address data is processed by way of an address preparation utility for generating a ZIP Code distribution listing. One or more destination entry locations associated with the plurality of mail articles is determined based on the ZIP Code distribution listing. A value of destination entry discounts associated with the plurality of mail articles is estimated based at least in part upon the one or more destination entry locations. In response to the determination of the one or more destination entry discounts, delivery carrier information associated with the mailing is received. The delivery carrier information includes at least a cost of transporting one or more of the plurality of mail articles to each destination entry location.

In yet another aspect is a method of processing a mailing including a plurality of mail articles. The method includes deriving mail characteristics data from postal authority electronic mailing documentation by way of mail processing or generating equipment or by way of a data center processor. One or more destination entry locations associated with the plurality of mail articles is determined based on the postal authority standardized electronic mailing documentation. A value of destination entry discounts associated with the plurality of mail articles is estimated based at least in part upon the one or more destination entry locations. In response to the determination of the one or more destination entry discounts, delivery carrier information associated with the mailing is received. The delivery carrier information includes at least a cost of transporting one or more of the plurality of mail articles to each destination entry location.

Also provided is a system for processing a mailing with respect to destination entry discounts. The mailing is representative of a plurality of mail articles. The system includes a logistics, engine for estimating a value of destination entry discounts associated with the plurality of mail articles based at least in part on received address data related to the plurality of mail articles. Also included is a logistics service provider capable of communicating with the logistics engine. The logistics service provider generates delivery carrier information associated with one or more delivery service providers and the delivery carrier information includes at least a cost of transport of one or more of the plurality of mail articles to each destination entry location. A user interface is included for conveying one or more net cost savings opportunities. The net cost savings opportunities are representative of the difference between the cost of transport and the estimated value of destination entry discounts associated with one or more of the plurality of mail articles.

Additional advantages and aspects of the present subject matter will become readily apparent to those skilled in the art from the following detailed description, wherein embodiments of the present subject matter are shown and described, simply by way of illustration of the best mode contemplated for practicing the present subject matter. As will be described, the present subject matter is capable of other and different embodiments, and its several details are susceptible of modification in various obvious respects, all without departing from the spirit of the present subject matter. Accordingly, the drawings and description are to be regarded as illustrative in nature, and not limitative.

BRIEF DESCRIPTION OF THE DRAWINGS

The following detailed description of the embodiments of the present subject matter can best be understood when read in conjunction with the following drawings, in which the various features are not necessarily drawn to scale but rather are drawn as to best illustrate the pertinent features, and in which like reference numerals are employed throughout to designate similar features.

DETAILED DESCRIPTION

Figure 1:
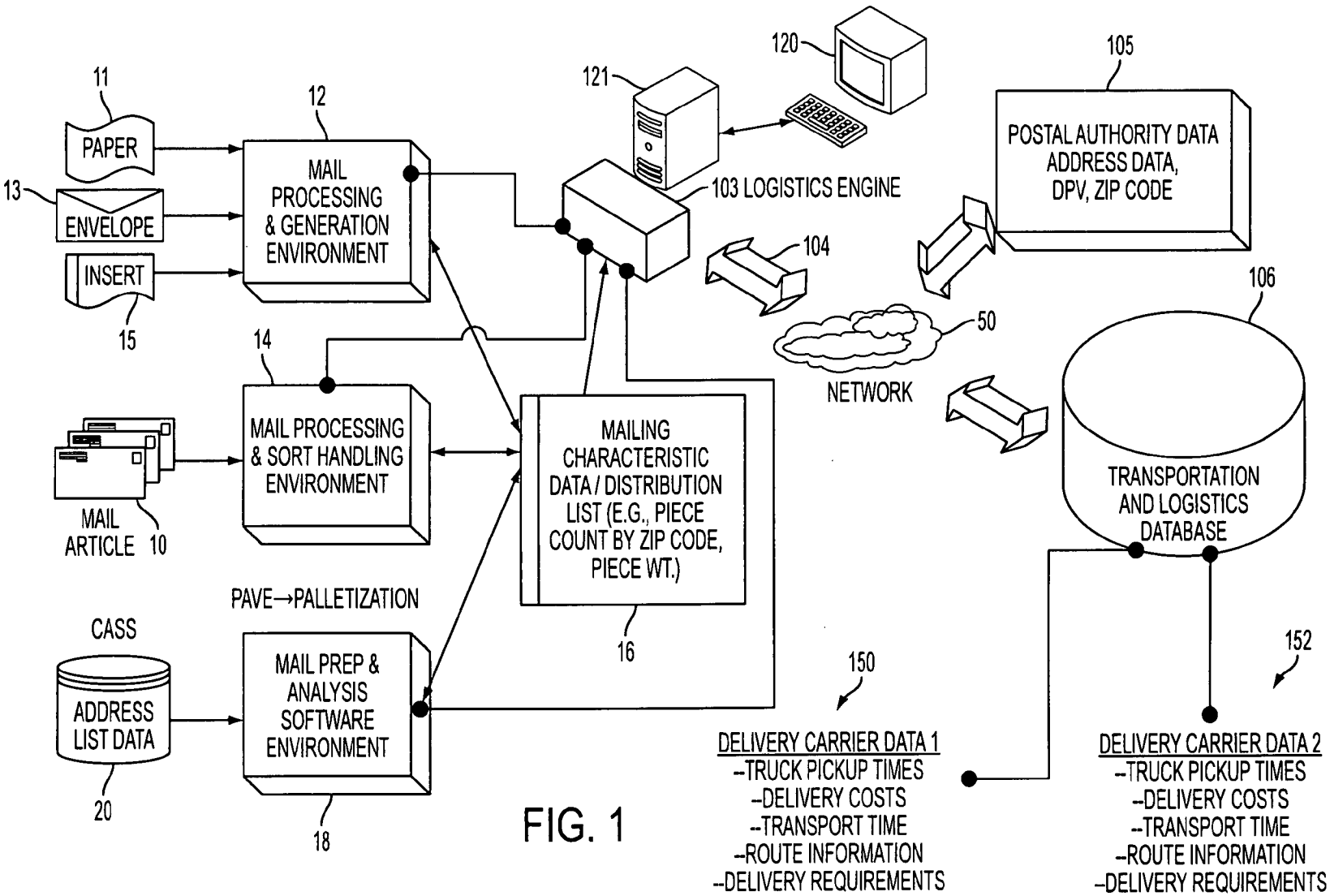
FIG. 1 is an exemplary high-level depiction of a schema for enabling destination entry discounts to be accounted for and enabled with respect to various mail processing environments.

The teachings described herein pertain to mail preparation systems, and more specifically to the processing of mailings to enable destination entry discounts. The teachings herein also pertain to the processing of mailings by various document processing systems, such as sorters, inserters or vision systems attached to document processing systems, to enable processing of mail articles for maximum destination entry discounts. Still further, the teachings pertain to a scheme for the enablement of delivery and logistics information to be arranged respective to a mailing seamlessly during mail processing to enable destination entry discounts. It will be recognized by those skilled in the art that the teachings herein pertain to any class of mailing as may be processed by a document processing device, or prepared by way of a mail preparation software package. The various mail classes include, but are not limited to first class mail, business mail, standard mail, parcel post, etc.

The teachings described herein also pertain to the processing of mailings with respect to destination entry discounts and transport options in varying mail processing environments. Indeed, as will be discussed in greater detail later, different processing environments may come into play in correspondence with the varying lifecycle of a mailing. So, for example, a mail processing and generation environment may correspond to the creation or assembling of mail articles (e.g., via a data center processor or inserter), while a mail processing and sort handling environment may correspond to the movement of physical mail. Regardless of the processing environment in question, the teachings may be applied in any mail processing environment wherein mail makeup information may be generated and/or ascertained. Mail makeup information pertains to any data that conveys the characteristics and/or attributes of the plurality of mail articles comprising a mailing, and specifically those pertinent to the distribution of mail via a postal authority or delivery of said mail to an intended recipient. In general, the mail makeup information may be derived in concurrence with, or resulting from, the processing of a mailing in a particular processing environment. Mail makeup information may include, but is not limited to, total piece count info, ZIP Code groupings and/or pre-sort category groupings (e.g., 3-digit, 5-digit, scheme groupings, AADC, mixed AADC), counts by ZIP Code and/or presort grouping, weight of the mailing, etc. This information may be presented in one form, format or order depending on the processing environment from which it is derived and/or the device or utility from which it is derived. Nonetheless, those skilled in the art will recognize that the teachings are not limited to any one form, format or order of mail makeup information, and that any information about the mailing that is useable for associating destination entry discounts and mail transport options is within the scope of the teachings.

Turning now to FIG. 1, an exemplary high-level depiction of a schema for enabling destination entry discounts to be accounted for and enabled with respect to various mail processing environments. In a first environment, such as a lettershop or the like, a plurality of mail articles may be generated by one or more inserter devices (not shown), corresponding to a mail processing and generation environment 12. Inserter devices for operating in this kind of environment are well known in the art, and they may perform various operations at high speeds on paper 11, envelopes 13, insert materials 15, and other items necessary for generating high volumes of mail articles. Accordingly, the one or more inserters may employ an inserter control software and/or operating system. In addition, the inserter may employ one or more image capturing devices and accompanying image data analysis tools for inspecting the integrity of, or tracking said mail articles as they are processed. Typically, the analysis and interpretation of image data is performed through the use of optical character recognition (OCR) or barcode recognition technology—utilities useful for enabling mail article recognition and tracking as each mail article is processed through the inserter(s). So, for example, an imaging device may be optionally placed downstream on an inserter device near the final output trays for inspecting each mail article as they accumulate. OCR systems may include an optical scanner for reading text, and sophisticated software for analyzing captured image data (e.g., glyphs, objects, graphics primitives). Alternatively, the OCR system may include a combination of hardware (e.g., specialized circuit boards) and software to recognize characters, or can be executed entirely through software. Those skilled in the art will recognize that various systems may be employed by the imaging device for the purpose of recognizing and analyzing a plurality of address components and other image data that may reside on the mail article. Furthermore, those skilled in the art will recognize that the image analysis utility (e.g., OCR) could be programmed to perceive various markings on a mail piece including but not limited to, trainable OCR fonts, sequence numbers, 2D symbologies, address masking detection, indicia print errors, POSTNET barcodes, etc.

In a processing environment such as a presort bureau or the like, a plurality of physical mail articles 10 are handled for sortation by a sorter device (not shown), corresponding to a mail processing and sort handling environment 14. Physical mail articles 10 act as input items to be processed in this environment (e.g., mail articles generated by an inserter device within the mail processing and generation environment 12). Sorter devices operating in this environment are well known in the art, and may be configured with one or more image capturing devices and image data analysis tools for interpreting the markings (e.g., addresses, ZIP Codes) that appear on the mail articles 10. Furthermore, the sorter may employ the use of sorter control software or control operating systems which provide the necessary logic, algorithms and processing schemes required for sorting the mail articles in accord with the markings detected thereon. The sorter and accompanying control software may be implemented for the processing of inbound mailings, such as a sorter for segregating and sequencing mail that arrives in a corporate mailroom. Alternatively, the sorter and control software may be configured for the processing of outbound mailings, including the ability to compile data descriptive of the characteristics of the mailing into a postal authority report (e.g., mail manifest, mail qualification report). The sorter performs the sorting of a mailing through the execution of one or more passes, or movements of the mailing through the sorter device, for enabling the application of applicable sort schemes based on the perceived characteristics (e.g., markings printed thereon) of the mailing as detected. Each mail article is then assigned to an appropriate output tray based on at least the sort scheme/rules and/or markings (e.g., address designation) on the mail article.

Whether physical mail articles 10 are fabricated in a mail processing and generation environment 12 or arranged in a mail processing and sort handling environment 14, both environments may employ some form of image capture and image data analysis tools for characterizing the mailing (e.g., determining the mail makeup). By characterizing the mailing it is meant that various mail characteristics and/or attributes that pertain to and affect the quality of distribution of the mailing through the postal network and to the intended recipient may be determined. Such mail makeup information with respect to the mail generation environment 12 and mail sorting environment 14 is referred to as mail characteristic data; depicted in FIG. 1 as the data box referenced 16. The mail characteristic data for the environments 12, 14 may include, but is not limited to: the recipient's name or entity name, street name, P.O. Box number, building name, postage or indicia marking, numerical ZIP Code, City, State, weight, etc. In addition, the mail characteristic data 16 may include keyline data for internal processing, or piece weight data as relayed by a meter or specified by the mailer in accord with the type of mail article under process. Still further, the mail characteristic data 16 may apply to information that is not readily human readable, such as two-dimensional barcode information, POSTNET, 4-STATE, and PLANET barcode information. Indeed, mail characteristic data 16 may include a combination of human-readable and machine-readable data for conveying address information and other info required to expedite processing of a mail article via postal authority rules. As mail characteristic data is compiled, it can be further refined to convey piece count info, ZIP Code groupings and/or pre-sort category groupings (e.g., 3-digit, 5-digit, scheme groupings, AADC, mixed AADC), counts by ZIP Code and/or presort grouping, weight class information, counts by weight class, postage due info, etc. Hence, mail characteristic data 16 may convey info pertaining to each individual mail article, as well as information respective of the collective mailing.

Another means of characterizing a mailing is via the processing of address data 20 by a mail preparation and/or analysis software package. Mail preparation software may include, but is not limited to, any software that applies address validation, updating and/or standardization services to address list data such as Delivery Point Verification (DPV), National Change of Address verification (NCOALink), Locatable Address Conversion System (LACSLink) verification, Coding Accuracy Support System (CASS), Presort Accuracy Validation and Evaluation (PAVE), and other such address processing schemes respective to postal authority standards. The software may be employed by various types of users, including large and small captive mailers, lettershops, dedicated mail processing bureaus, direct marketing agencies, print shops and any other organizations desiring to ensure the integrity of a mailing. In some instances, some of the above described services, such as CASS or DPV, may be performed in advance of the address list data being processed in the mail preparation and/or analysis software environment 18.

The mail preparation and analysis software environment 18 may be employed within the other described processing environments 12 and 14. Hence, a lettershop, print shop, captive shop or other processing environment requiring one or more sorters and sort control systems, inserters, imaging systems and accompanying image data interpretation utilities, may also utilize mail preparation and analysis software 18. However, unlike the previously described processing environments 12 and 14, the mail preparation and analysis software 18 environment relies upon the analysis of address data 20 provided as a means of determining the mail makeup and/or character of a mailing. Generally, the mail makeup data may be generated as a ZIP Code distribution list which represents the destination entry locations corresponding to a given ZIP Code. In contrast, processing environments 12 & 14 rely upon interpretation of image data as acquired from the physical mailing as a means of deducing the mail characteristic data 16. Suffice to say, there are at multiple alternatives for the derivation of the mail characteristics data needed by the logistics engine to evaluate the economics of destination entry discounts versus the logistics cost and scheduling.

It is even possible to generate and/or ascertain mail makeup information from a Mail.dat file or other postal authority approved electronic mail information medium and format. Generally, Mail.dat files are transmitted to the postal authority by a data center processor or directly by a sorter device. Both operate upon a mailing to ensure proper sortation of the mailing by presort category/grouping in accordance with sortation rules. However, the data center processor operates upon electronic representations of the mailing such as applying move updating or address cleansing services to addresses specified within the mailing (prior to creation of a print file), while the sorter and inserter devices operate upon physical representations of the mailing (after generation and printing of the mail articles). Regardless of how the mail characteristic data is created and/or determined, those skilled in the art will recognize that the teachings herein provide a means for readily translating such data into information respective of destination entry discounts and drop ship/destination entry options relative to a mailing.

In accord with the present teachings, and operable within each of the differing processing environments 12, 14, and 18 is a logistics engine 103. The logistics engine 103 is an executable module, implemented as hardware, software or a combination thereof, which accesses relevant transportation and logistics information from a logistic server/database 106 via an established communication channel 104 and network 50. The logistics server/database 106 is maintained by a logistics service provider having access to transportation and logistics information as provided by the logistics service provider directly, or by one or more external delivery service providers. Once obtained, the logistics and transportation information can then be conveyed to the sorter control system, inserter control system, image data analysis utility, or mail preparation software depending on the processing environment. Each of the systems identified above have at least an integrated display and graphical user interface (GUI) interface as shown in FIGS. 1-6 as 120, 124, 167, 224, 227 and 314 that is either a part of the system or is connected to a server that connects multiple systems. Certain output data generated or acquired by the logistics engine can be made available according to whichever format and upon whichever display best serves the operational needs of the enterprise. Hence, the logistics engine 103 enables transportation logistics information to be available in connection with the mail characteristic data 16. Delivery carrier and transportation information for one or more delivery companies 150, 152 is retrieved from the logistics server/database 106 in response to data requests or commands given to the logistics engine 103 (e.g., requests from the mail preparation software or sorter control system). Non-limiting examples of data types or outputs that the logistics engine 103 may provide in connection with an analysis of the mail characteristic data 16 are identified in Table 1.

TABLE 1

| Delivery Carrier Data Types |
|---|
| Basic delivery/carrier profile |
| Scheduled mail pickup times and routes |
| Shipping options and transport times |
| Delivery costs |
| Inclement weather conditions that may affect delivery |
| Comparative delivery carrier data (e.g., data with respect to a plurality of delivery or transport vendors) |
| Delivery and servicing requirements information |

Functionally, the logistics engine 103 may be implemented as an independent processing module executable by a separate computing device (e.g., server) communicable with the various devices employed within the differing processing environments 12, 14, and 18. Alternatively, the logistics engine 103 may be implemented as an add-on executable component—i.e., DLL, COM object—that operates concurrently and seamlessly with: the sorter control software and/or operating system in the mail processing and sort handling environment 14, the inserter control software and/or operating system in the mail processing and generation environment 12, the image capture and image analysis utilities within environments 12 and 14, and with the mail preparation software in its respective processing environment 18.

In addition to retrieving and conveying transport logistics data 106, the logistics engine 103 may also perform various analytic functions based on the mail characteristic data 16, such as determining which destination entry locations correspond to a particular ZIP Code, and/or determining the net effective discount or savings opportunity [destination entry discounts minus cost of transport=net effective discount/savings opportunity]. Such analytics could be performed by the logistics engine 103 independently, whereby relevant mail characteristic data—i.e., piece counts by ZIP Code, piece weights—is communicated to the logistics engine 103 so that it may perform the analysis of the data accordingly. In this way, the results of the analysis would simply be returned back to the requesting party, such as the sorter or inserter control system, image data analysis utility or mail preparation software. Alternatively, the logistics engine 103 may perform the analysis in conjunction with said processing tools utilized in a respective processing environment. More regarding the various types of analysis performed will be described in later sections of the description. For now, attention will be placed upon FIGS. 2, 3 and 4, which depict the exemplary processing environments 14, 12 and 18 of FIG. 1 respectively in accordance with the teachings herein.

Figure 2:
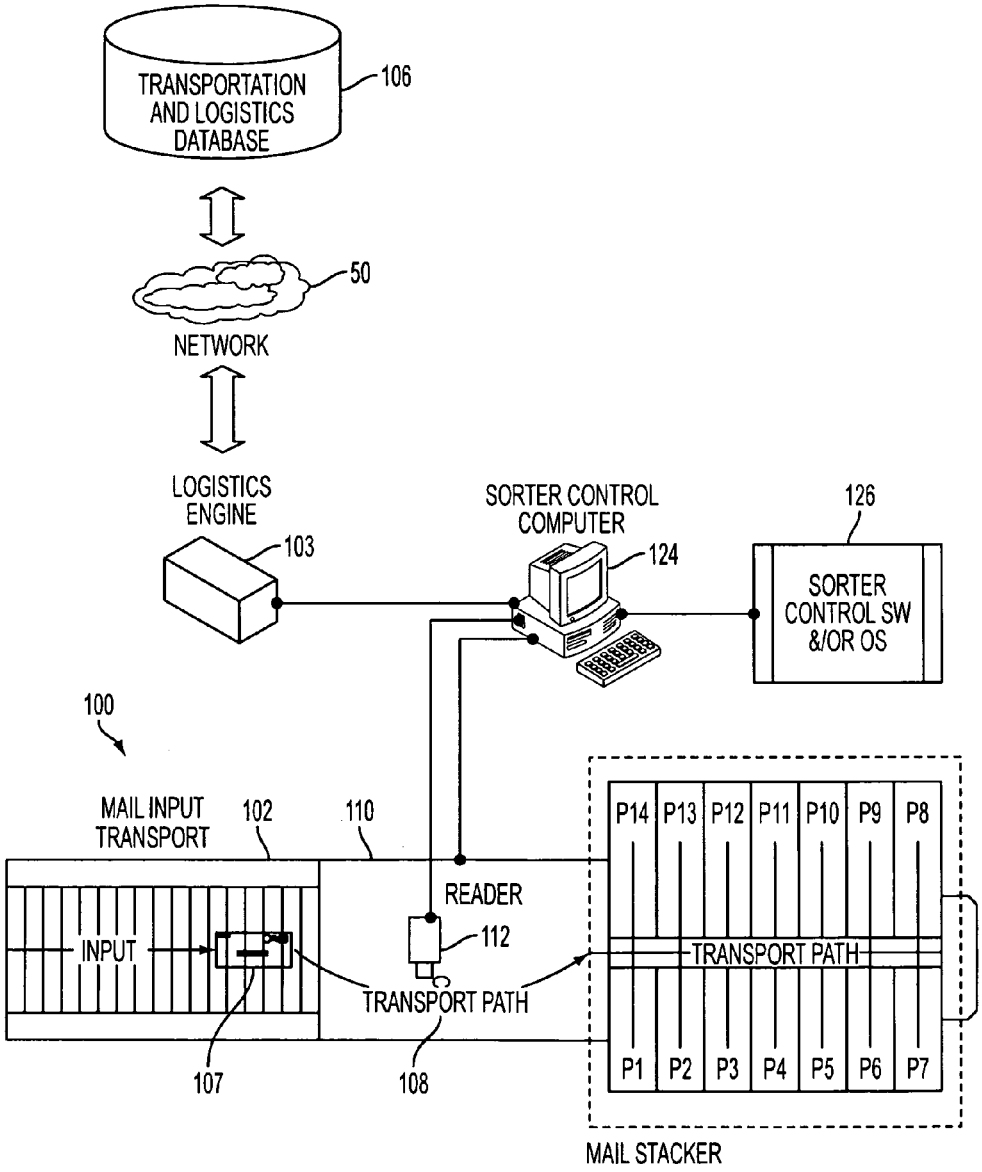
FIG. 2 is an exemplary depiction of a sorter device enabled for destination entry discount processing.

As stated above, the mail processing & sort handling environment 14 may include one or more sorter devices 100 for processing a plurality of mail articles. An exemplary sorter device 100, as depicted in FIG. 2, may include a mail input transport 102 for inputting mail articles 107 and subsequently transporting them along a transport path 108 via a system of mechanized pulleys, levers and rollers. An imaging system 110, such as a reader device 112, acquires image data representative of the markings on each input mail article 107. As discussed, the ability for the various markings upon the mail article 107 to be identified (e.g., recipient address, ZIP Code, bar code) by the reader device 112 is provided by an OCR utility or the like, which may reside upon a sorter control computer 124. In other implementations, the OCR utility or other image interpretation utility may reside in a separate device capable of communicating with the sorter control computer 124. As the mail articles comprising the mailing are interpreted (e.g., via a first pass of all mail articles through the sorter 100), this information is also processed by a sorter control software and/or operating system 126 also executable by the sorter control computer 124. The sorter control software and/or operating system 126 provides the various commands, controls, functions and instructions that dictate the electronic and mechanical operation of the sorter device 100. Furthermore, the sorter control software and/or operating system 126 may translate the image data acquired by the OCR utility into mail characteristic data—i.e., piece counts by ZIP Code—descriptive of how the mailing is composed. The mail characteristic data is then utilized by the sorter control software and/or operating system to dictate how each mail article of the mailing is to be arranged into one or more mail pockets P1 through P14, such as to obtain presort discounts.

In accordance with the teachings, a logistics engine 103 may also be implemented in connection with the sorter control software and/or operating system 126 for enabling the processing of a mailing with respect to destination entry discounts. Once the mail characteristic data pertaining to the mailing is determined, the logistics engine 103 and sorter control software and/or operating system 126 may perform a destination entry analysis. Table 2 identifies the exemplary destination entry analysis data types.

TABLE 2

| Destination Entry Analysis Data Types |
|---|
| Relevant DDU, SCF, and BMC locations by ZIP Code, region or neighborhood |
| Relevant Destination Area Distribution Center (DADC) locations and relationships (e.g., for mail articles classified as periodicals) by ZIP Code |
| Relevant Processing and Distribution Center (P&DC) and Sectional Center Facility (SCF) locations and relationships by ZIP Code |
| Relevant Regional Distribution Centers (RDC), Local Processing Centers (LPC) and Destinating Processing Centers (DPC) locations and relationships by ZIP Code |
| Relevant authorized mail processing machines within the network by location, region and/or zone by ZIP Code (e.g., machine 4 located in zone 5 of SCF 2) |
| Applicable destination entry postage discount price per piece by relevant destination entry type (e.g., if BMC entry = $0.021) |
| Postal authority destination entry documentation and requirements information |

This information may then be presented to the user of the sorter device 100, by way of a software graphical user interface (GUI), for conveying the various destination entry discount opportunities available with respect to the mailing. In addition, a sort by destination entry discount analysis may be performed, so as to determine the exemplary configuration of the mail articles into the various mail pockets P1 through P14 as required for entry discounts. This exemplary result could too be displayed to the user, enabling them to visualize mail pocket sequencing in advance of sortation. Still further, the logistics engine 103 may communicate with a transportation and logistics database 106 via a network 50 to retrieve delivery carrier data (refer to Table 1). This data may be exchanged with the sorter control software and/or operating system 126, and subsequently rendered to the software graphical user interface (e.g., the user interface to the sorter control software and/or operating system). As such, the user may evaluate the various destination entry discounts relative to the mailing, as well as determine the various transport options at their disposal for ensuring drop ship delivery. Alternatively, the user may even be presented with multiple delivery carrier data sets respective of differing carriers or delivery companies for engaging in comparison shopping.

Having acquired the mail characteristic data associated with the mailing, the relevant destination entry data types (see Table 2), and the delivery carrier data (see Table 1), further analysis options may be enacted by the logistics engine 103 and/or the sorter control software and/or operating system 126. For example, a comparison may be performed between the destination entry discounts by entry category, individual ZIP Code designation or for the entire mailing versus the transportation costs respectively to reveal a net savings amount. The analysis may also be performed to restrict the display of destination entry locations where no net effective savings opportunity exists, while displaying those that do offer a savings opportunity. So for example, if the cost of drop ship transport to a destination entry location corresponding to ZIP Code 60090 exceeds the amount of applicable discount to this location, a recommended net savings opportunity analysis may be suppressed for display to the user. The user may then have the option of processing those with no net savings locally for postal authority delivery. Another analysis may be performed to compare transport times and pickup times, such as to engage expedited shipping (rush job) options while still enabling relevant destination entry discounts. Other analytic functions may include, but are not limited to, processing and activation of delivery arrangements, compilation of postal authority required documentation and mailing reports, compilation of mailer reports (e.g., production report), etc.

Figure 3:
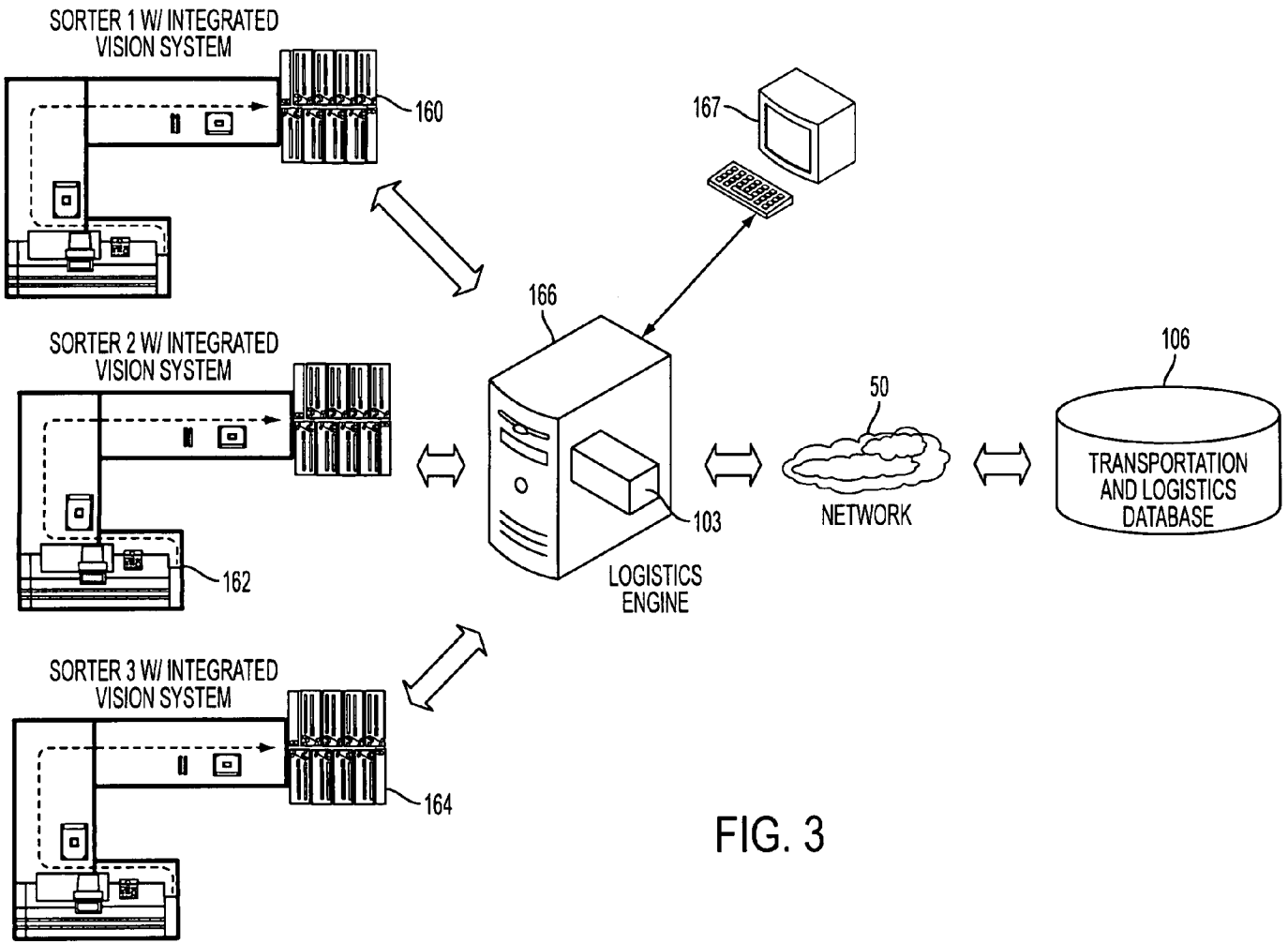
FIG. 3 depicts an exemplary distributed sorter device environment enabled for destination entry discount processing.

The exemplary teachings as depicted in FIG. 2 may also be applied in an exemplary distributed mail processing and sort handling environment 14, as shown in FIG. 3. Large mailings to be sorted (e.g., quantities in the millions) may require the concurrent or independent activity of multiple sort devices, shown in this example as sorter device 1 160, sorter device 2 162, and sorter device 3 164. As in FIG. 2, each of the sorters may have an integrated image system for acquiring image data associated with each mail article. The logistics engine 103, shown in this example as executable by an independent but communicable server computer 166, may still perform the various functions already described above. If required, the logistics information could even be displayed to a user via a display 167 in accord with a preferred user format. In this case, however, the logistics engine 103 may work with the one or more sorter control software and/or operating systems executable in connection with the sorter device 160, 162 and 164. This may include the aggregating of data 16 in instances where a single logistic engine 103 is employed. Optionally, a separate logistics engine 103 may operate in conjunction with a sorter device (e.g., three sorters=three logistics engines), and then share information with each other via a common sorter control software and/or operating system. Indeed, those skilled in the art will recognize that various workload and data sharing arrangements in such an environment are well known, and that the teachings herein are not limited to any particular arrangement. Furthermore, those skilled in the art will recognize that in both a distributed and undistributed processing environment, the logistics engine 103 may optionally communicate with the image capture system and/or analysis tool, such as the reader system 110 of FIG. 2. Similarly, the logistics data can be displayed on a central server display 167 and/or on the individual sorter displays 124. In this way, the various analysis functions described above may be performed independent of the sorter control software or control system, and the results presented to the sorter control system for processing.

Figure 4:
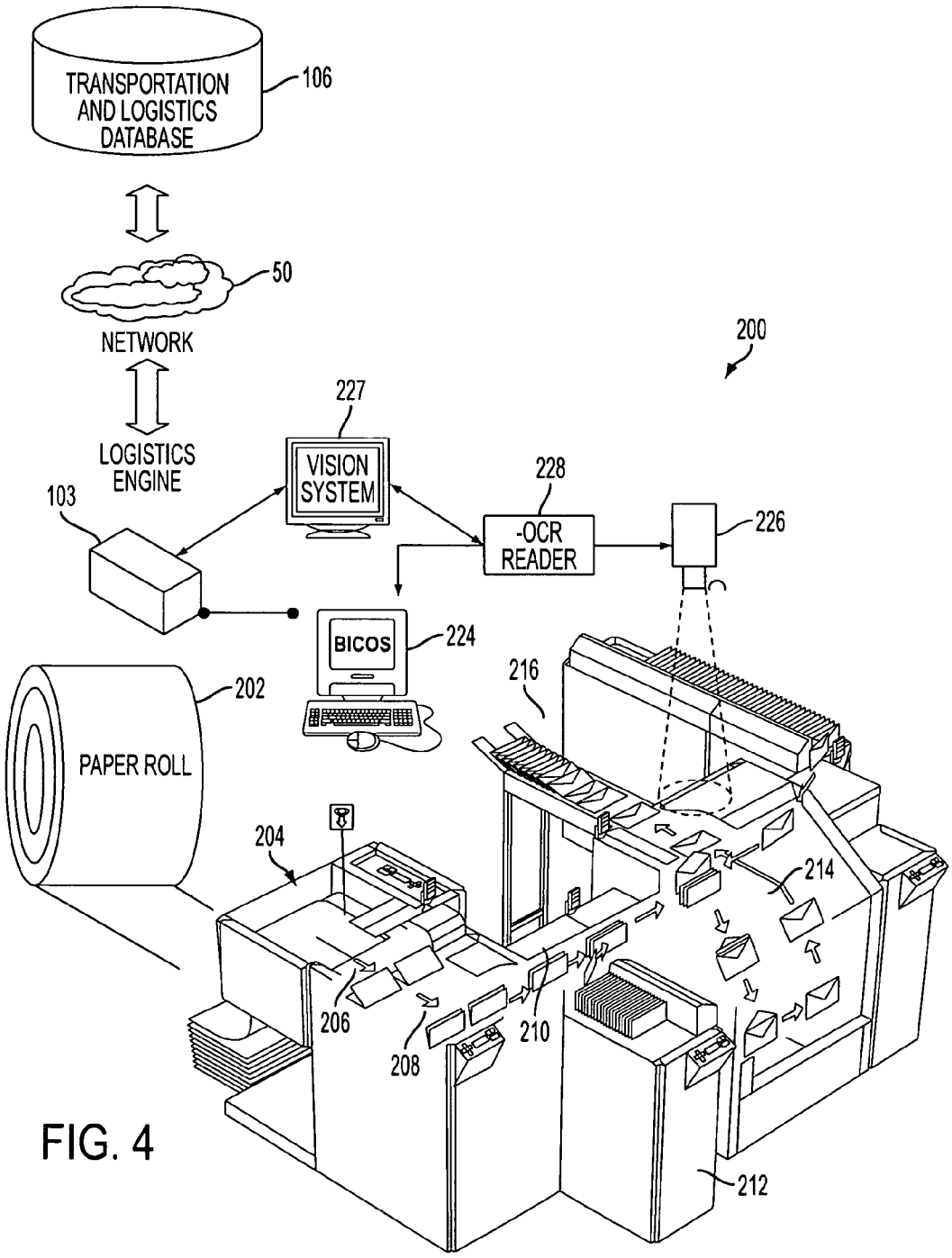
FIG. 4 is an exemplary depiction of an inserter device enabled for destination entry discount processing.

Reference is now made to FIG. 4, which depicts an exemplary inserter device 200. The inserter 200 may comprise a plurality of modules which are electrically and/or mechanically coupled to perform various document processing operations. A paper roll 202, generally having printed mail piece markings on it (e.g., text, barcodes, sequence numbers or graphics—printers not shown) is fed into a cutting module 204 for dividing the paper roll into individual sheets. These sheets, which may or may not be two-sided, are then passed on to a folding module 206 to be configured into single-fold, z-fold, or wrapped documents. Once folded, the documents are placed into an accumulator (not shown), which combines pages in a predetermined order for processing by an upright module 208 and assembles them into a collation track 210. Upon assembly, an insert feeder 212 may be provided for adding additional inserts and collating them for insertion into an envelope by an inserting station 214. The inserts are sealed into the envelope, and then passed on to an output transport device 216 for further processing downstream (e.g., processed by one or more imaging devices 226, postage meters or stackers).

An inserter control computer 224 may have inserter control software and operating systems for controlling the operation of each of the components of the document processing system 100. In connection with the inserter control computer 224 may be imaging device 226 for acquiring image data, and a image data analysis utility 228 with accompanying operator user interface 227 for control, setup, and overall vision system operation. As before, the OCR or barcode reader utility 228 may operate in connection with the image capturing device for enabling recognition of the markings on each mail article. The image data may subsequently be translated accordingly into mail characteristic data. A detailed explanation of the techniques needed to create the mail characteristics data from successive images of all mail pieces produced by the inserter can be found in U.S. patent application Ser. No. 11/592,164, entitled Verification Appliance, filed Nov. 3, 2006, which is herein incorporated by reference in its entirety. In accord with the exemplary teachings, a logistics engine 103 may also be implemented in connection with the inserter control software and/or operating system 224. In this way, the inserter control software and/or operating system or the image data analysis utility 228 may generate the mailing characteristics data 16 with respect to destination entry discounts (via network retrieval 50 of transport logistic data from the logistics server/database 106). Exemplary operations performed include, but are not limited to: organization of mail articles into output trays in accord with destination entry transport arrangements, organization of mail articles into output trays in accord with destination entry groupings, drop ship labeling, generation of mailer reports (e.g., production reports), processing and activation of delivery arrangements, etc. Also, as described previously, various pricing, net savings opportunity information, exemplary palletization schemes may be displayed to the user via the inserter control interface.

Figure 5:
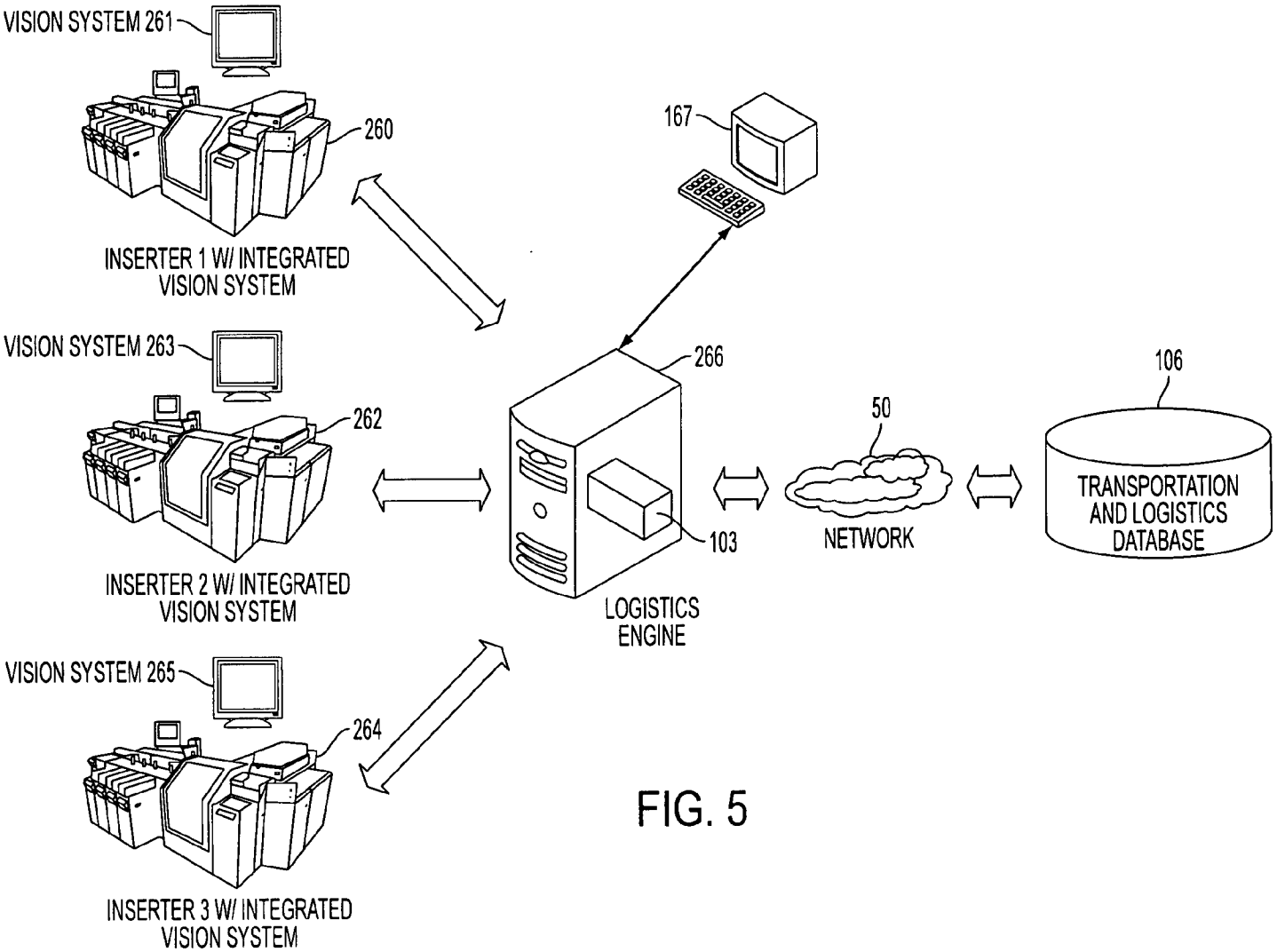
FIG. 5 depicts an exemplary distributed inserter device environment enabled for destination entry discount processing.

The exemplary teachings as depicted in FIG. 4 may also be applied in an exemplary distributed mail processing and generation environment 12, as shown in FIG. 5. Large mailings to be generated (e.g., quantities in the millions) may require the concurrent or independent activity of multiple inserter devices and vision systems, shown in this example as inserter device 1 260, inserter device 2 262, and inserter device 3 264 and vision systems 261, 263, 264. As in FIG. 4, the vision systems may be integrated with each of the inserters for acquiring image data associated with each mail article processed. The logistics engine 103, shown in this example as executable by an independent but communicable server computer 166, may still perform the various functions described above. Certain output data generated or acquired by the logistics engine 103 can be made available according to whichever format and upon whichever display best serves the operational needs of the enterprise and/or operator. For example, the results of the logistics analysis may be displayed on the system display 167 or could be distributed to the inserter control system 224. Regardless, any means for enabling the operator to select, view, or analyze the logistic options desired and further schedule the necessary operations for destination entry delivery is within the scope of the teachings herein.

Figure 6:
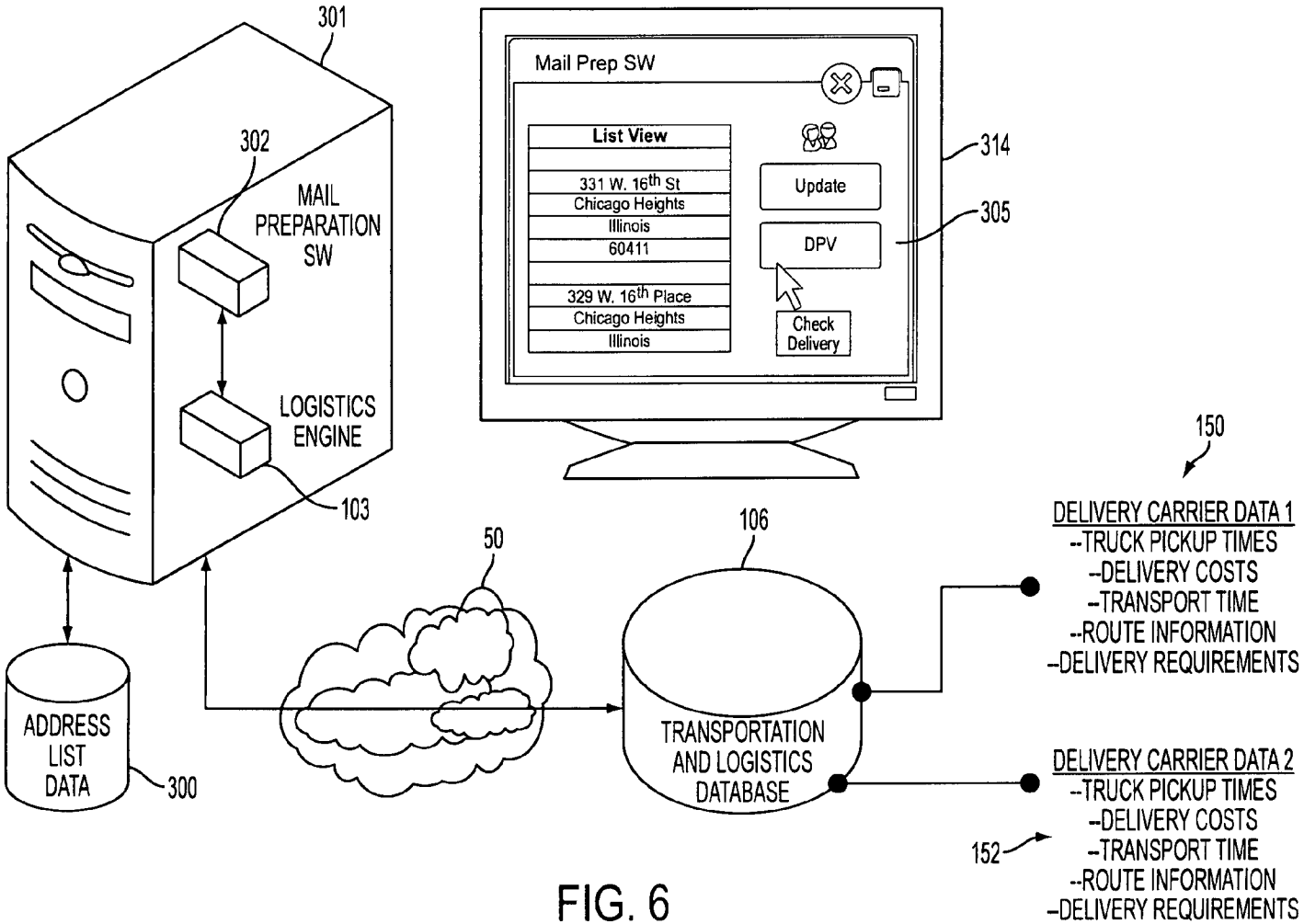
FIG. 6 is an exemplary high-level depiction of mail preparation software enabled for destination entry discount processing.

Turning now to FIG. 6, an exemplary high-level depiction of an environment for enabling integration of mail preparation software with relevant transportation metrics for obtaining destination entry discounts is shown, corresponding to processing environment 18 of FIG. 1. The integration of mail preparation software 302 with up-to-date transportation logistics information enables the mailer to process address list data 300 with respect to destination entry discounts in preparation for destination entry placement. Specifically, the mailer or agent thereof (e.g., print shop) executes a computing device 301 having stored and executable thereon mail preparation software 302. The mail preparation software 302 may comprise one or more executable modules—APIs, DLLs, objects, base instruction sets, etc.—for performing various address integrity, address validation, address standardization and other like services upon a mailing list provided as input to the mail preparation software 302. Depending on the functional requirements, the mail preparation software 302 may possess some functions to evaluate the resultant address data to create the presort discount groupings needed for logistics planning. In operation with the computing device 301 is a monitor 314, a graphics display device for which the various software components executable by the computing device (e.g., the mail preparation software 102 and/or a logistics engine 103) may render a user interface 305 to enable easier interaction with the user. Typically, the mail preparation software 302 will periodically access current postal authority address data 105, as shown in FIG. 1, for all valid addresses within its delivery area. This information may be acquired via a network connection 104 or directly from a data storage medium (e.g., a CD), as provided by the postal authority or approved postal authority vendor on a periodic basis. The address data enables the mail preparation software 102 to update or modify mailing list entries accordingly to provide the greatest opportunity for mail delivery within the postal authority network.

In accord with the present teachings, operable in concert with the mail preparation software 102 is the logistics engine 103, which accesses relevant transportation and logistics information from the logistic database 106 via the network 50. As before, the logistics engine 103 is capable of seamlessly exchanging relevant delivery carrier data (see Table 1) and/or command messages with the mail preparation software 302. In addition to exchanging relevant data and/or command messages, the logistics engine also performs—independently or in conjunction with the mail preparation software—the various analytic functions described previously based on mail characteristic data.

As interdependent processes and executable components, both the mail preparation software 302 and logistics engine may render various graphics displays to the user interface 305—i.e., menus, dialogue boxes, toolbars, etc.—to facilitate user interaction accordingly. So, for example, the logistics engine may invoke the display of a menu within the mail preparation software interface 305 of applicable shipping options based on the makeup of the mailing list. Those skilled in the art will recognize however that various user interface and display schemes for promoting user interaction with the software 302 and the logistics engine 103 may be employed. Ultimately, the integration of the logistics engine 103 with the mail preparation software 302 enables the mail preparation software 302 to analyze mailing lists with respect to various delivery carrier data types. Alternatively, the logistics engine 103 may reside within a separate computing device than computing device 301.

The logistics server/database 106 may be maintained by a service provider having the appropriate permissions for providing such data. So, for example, the service provider may provide delivery carrier data with respect to one or more delivery companies, as depicted in the exemplary figure as 150 and 152 respectively. In this example, differing sets of delivery carrier data representative of differing delivery companies is stored into the logistics server/database 106, providing a resource for which to enable delivery cost comparisons to further drive destination discounts by vendor. Alternatively, the delivery carrier data may be representative of a single delivery company, or even a dedicated delivery company affiliated with or operated by the service provider. Ultimately, the logistics engine 103 in exchanging said information with the mail preparation software 102 allows the software to perform the different comparative analysis presented above and present one or more options via the user interface 105.

Figure 7:
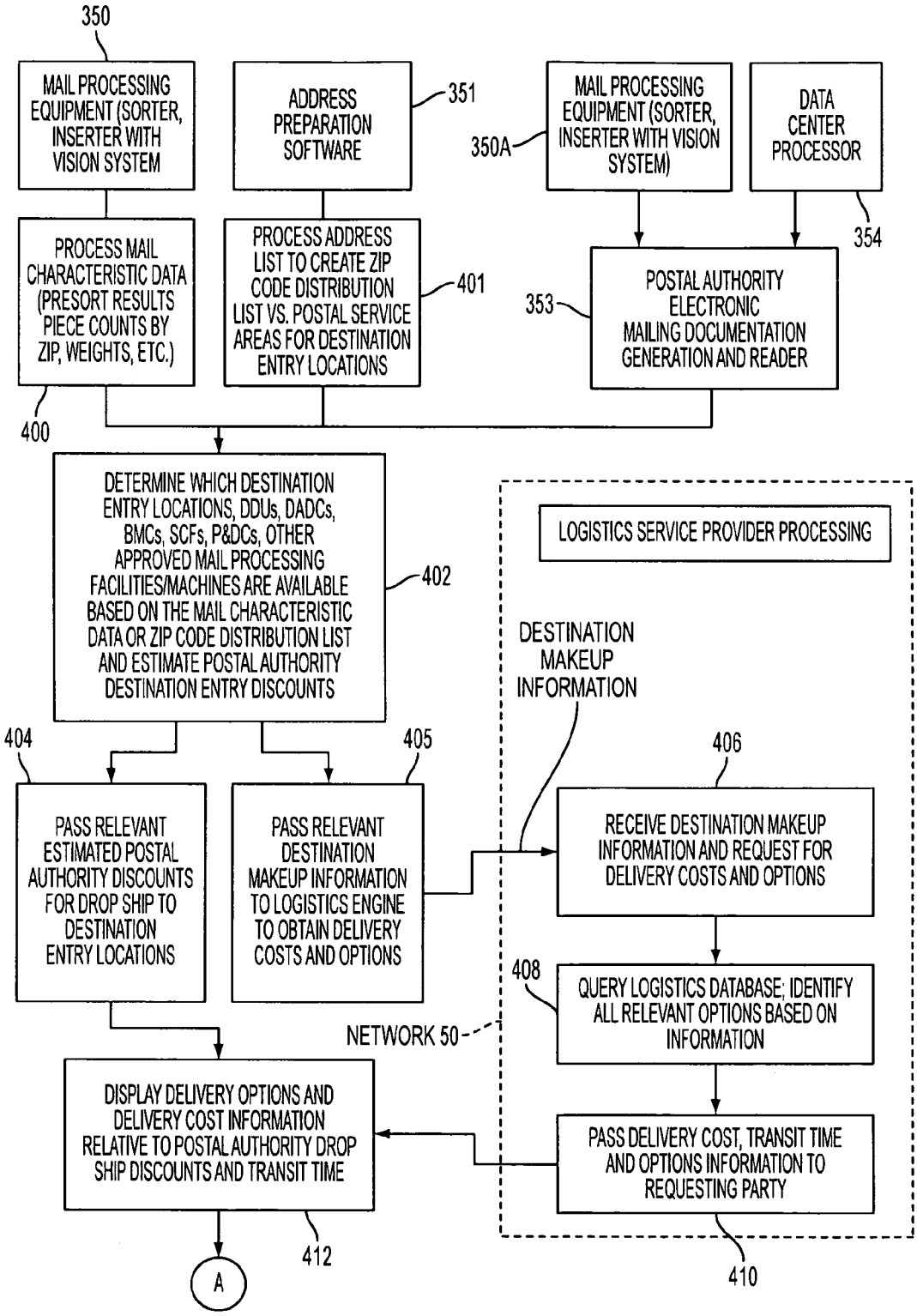
FIGS. 7-8 depict exemplary flowcharts which illustrates the procedure for processing a mailing with respect to destination entry discounts.
Figure 8:
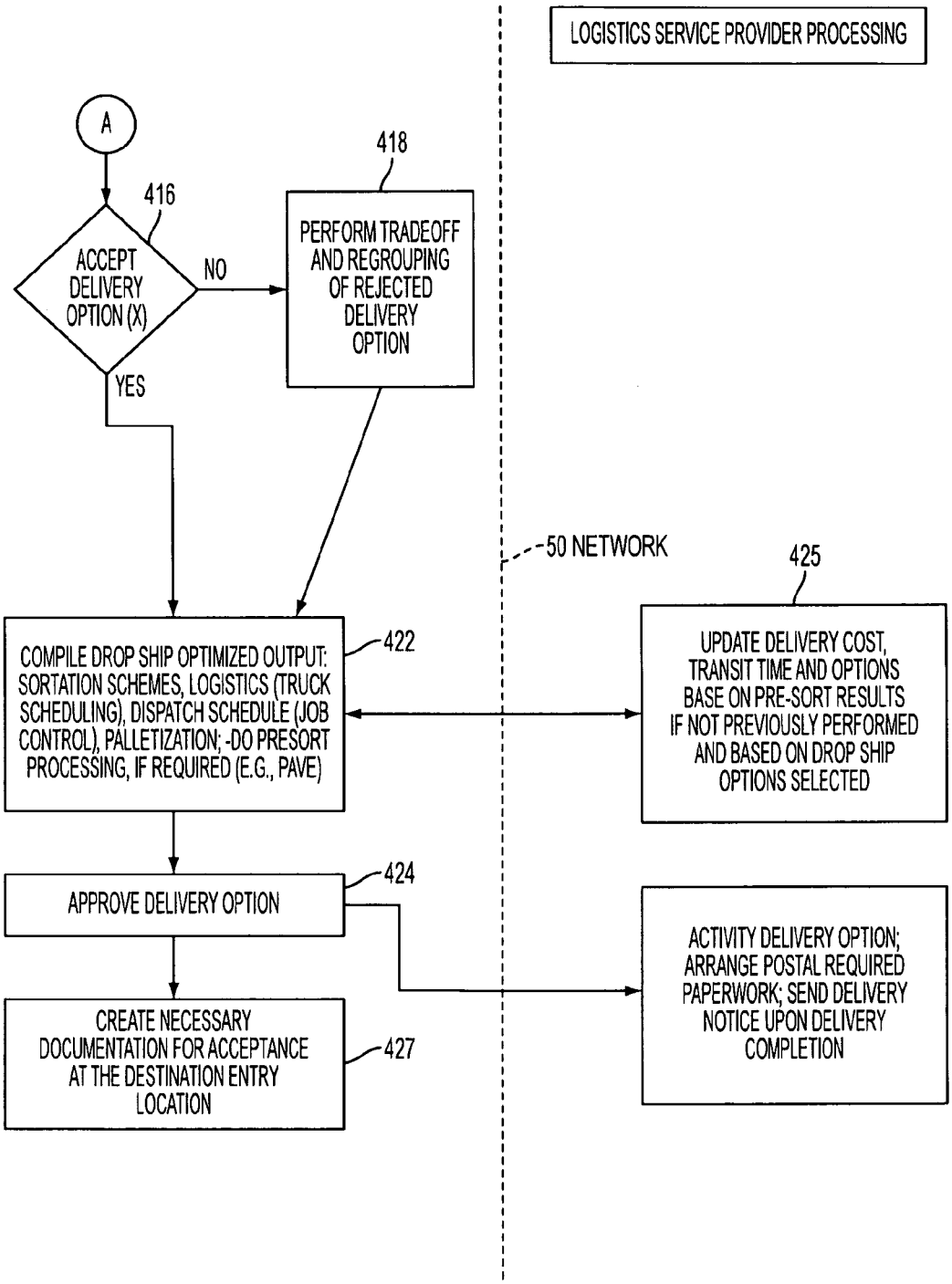

Reference is now made to FIGS. 7 and 8, which depicts exemplary flowcharts representative of the processing techniques presented herein. As previously mentioned, the need for mail processing operations to easily and accurately arrange for drop shipments of mail articles consisting of letters, flats and other parcels has increased due the discounts offered by postal authorities for this work share effort. For the USPS, while emphasis has been placed on standard mail, all classes of mail articles may be considered and therefore processed in accord with the present teachings. In addition, other postal authorities and private posts may offer destination entry discounts in the future. The automated destination entry analysis capability as performed in connection with the logistics engine 103 is based at least in part on mail makeup information derived from the devices or utilities employed in the various processing environments. This includes, but is not limited to the following: the mail processing equipment functioning within the mail processing and generation environment 12 and/or mail processing and sort handling environment 14 (such as sorters, inserters and inserters with vision systems), the mail preparation software or utility used to process a mailing within the mail preparation and analysis processing environment 18, and where applicable, the data center processor 354.

For the first case, mail processing equipment 350—i.e., a sorter with integrated reader device—creates mail characteristic data 16, which define the destination groupings for the mail articles that need to be provided to a postal authority for delivery. As mail characteristic data is compiled 400, it can be further refined to convey piece count info, ZIP Code groupings and/or pre-sort category groupings (e.g., 3-digit, 5-digit, scheme groupings, AADC, mixed AADC), counts by ZIP Code and/or presort grouping, weight, class information, counts by weight class, postage due info, etc. The mail characteristics data is then processed, such as by the logistics engine and/or applicable control software, to match the destination entry locations (DDUs, DADCs, BMCs, SCFs, P&DCs, and other approved mail processing facilities or machines within a facility) versus the mail characteristics. From this matching is determined the value of postal authority destination entry discounts 402.

For the second case, address preparation software (event 351), which typically processes client address lists, will provide the address data associated with the mailing to be processed into a distribution list of ZIP Code information versus postal service destination entry locations 401. This step provides additional flexibility to the logistics system since drop ship destination entry location data maybe used to refine the presort groupings without affecting the presort discounts. The ZIP Code distribution list is then processed within the logistics engine to match the destination entry locations (DDUs, DADCs, BMCs, SCFs, P&DCs, and other approved mail processing facilities or machines within a facility) versus the distribution list to determine the value of postal authority destination entry discounts (event 402).

A third alternative exists where mail characteristics data or the equivalent of a distribution list can be derived from a postal authority standardized electronic format such as, but not limited to, the Mail.dat format (the postal authority electronic document is referenced as Mail.dat in the description solely for ease of reference. No limitation in the possible use of alternative electronic formats is implied). Mail processing equipment such as sorters and inserters equipped with a vision system 350A are capable of generating Mail.dat documentation 353. Another source for Mail.dat data is the data center processor 354, which creates the print file used to print the documents that will be assembled into mail pieces with an inserter. The data center processor 354 may perform numerous functions besides the creation of the print file. Step 353 represents several possible steps which can include the generation of Mail.dat, formatting the Mail.dat into a format compatible with the logistics engine initial processing step 402 and reading and displaying the Mail.dat data for user review. The reader display is an alternative display to communicate the results of the logistics engine processing 412. Those skilled in the art may allocate these functions differently based on design preferences.

After the determination of drop ship destination entry locations and relevant discount (event 402) based on the distribution list (event 401), the Mail.dat or other postal authority approved electronic mail information medium and format (event 353), or the mail characteristics data (event 400), the resulting postal authority discounts 404 may be conveyed to the user 412 via a display system. Destination makeup information is subsequently generated (event 405), which contains all the data relevant for enabling the logistics service provider to transport or arrange for the transport of the mailing accordingly to the various destination entry locations. This data may include, but is not limited to, mail article piece counts, number and weight of containers, mail article pickup location information, and weight of the mail articles for each destination entry location for which the mail articles can be shipped for destination entry discounts and relevant scheduling data. This information may be automatically transferred over the network 50 such as the internet to the logistics service provider or providers (event 406). After the destination makeup data is received, it is analyzed (event 408) to determine at least the shipping costs and transit time for each destination entry location. This analysis may include querying of the transportation and logistics database hosted by the logistics service provider and extraction of transport data relevant to the destination makeup data. The resultant data is passed back to the requesting party, such as the logistics engine (event 410) via the network 50 and shown via a user display (event 412).

Once displayed, the user is armed with the data necessary to make a decision (event 416) as to what destination entry options are beneficial to the current site operations. The decision may be made based on comparisons such as, but not limited to, cost of shipping versus postal authority destination entry discounts and transit time to the destination entry locations. Transit time is important in instances where it is desirable to select a delivery option that is not cost effective but will shorten the total time needed to deliver an item using the private transportation system versus the postal authority transportation system. As another means of decision processing, the logistics engine independently or in connection with the relative mail processing control system, vision system or mail preparation software, may present the various estimated net discount opportunities. In doing so, the discount opportunities may be rendered to the screen in differing fonts or color schemes to distinguish them from those ZIP Code groupings that reflect no net savings. Those skilled in the art may employ other display features, options, and conveniences as needed.

In connection with the decision process (event 416), the user may further decide on a select basis amongst their relative offerings as opposed to a unilateral rejection or acceptance of all offerings presented. So, for example, the user may select a delivery option relative to a limited number of ZIP Code groupings comprising the mailing, while rejecting certain others. As another example, the user may select a delivery option for groupings within the mailing pertaining to a first delivery carrier, while rejecting the same offering for a second delivery carrier. In this scenario, further discount opportunities may be presented by enabling a form of transport comparison shopping as leveraged from access to destination carrier data from multiple sources.

For instances where one or more options are rejected (event 418), the rejected mail must be identified for reallocation to another shipment since all the mail must go to the postal authority for delivery. Once the various net discount opportunities and shipment decisions are complete, the accepted options must be compiled (event 422) to account for the user selected options or for the results of pre-sort processing (e.g., if required or not already performed). Both occurrences may result in some refinement of the destination makeup information and the resultant shipping costs and transit time. The updated destination makeup information, if applicable, is sent to the logistics service provider(s) (event 425) via the network 50 and updated shipping data is returned to the logistics engine (event 422). Compiled data may include, but is not limited to, sortation schemes, logistics (truck scheduling), dispatch schedule (job control) and palletization schemes.

The final step requires the user to approve the shipping delivery options (event 424). At this time a contract may be automatically executed or generated via the network 50 between the user and the logistics service provider(s). Once the shipping contract or order approval of event 424 is received, the service provider(s) may execute all necessary functions to complete the shipments (event 426). Resultantly, the logistics engine may independently, or in connection with the mail processing control system or software create the documentation needed by the postal authority for acceptance of the mail into the various destination entry locations 427. This documentation may be provided with each shipment or transmitted electronically to the postal authority and/or the service provider accordingly.

Those skilled in the art will recognize that the various processing and analytic functions performed in one mail processing environment may be performed equally in another. Furthermore, those skilled in the art will appreciate that the various functions described herein as being performed by the logistics engine may indeed be performed in conjunction with a mail processing control system (e.g., sorter or inserter control system), vision system, image data analysis utility, server, any or other processing device. Indeed, the functions and features presented in connection with the logistics engine are representative of functions and features which may be programmatically implemented by the mail processing device, control system or software in question. Indeed, one skilled in the art may separate certain functions and features of the logistics engine without limiting the scope of the teachings herein.

Ultimately, the present teachings provide a convenient means for enabling the greatest destination entry discounts to be accounted for ahead of or concurrent with the mail preparation, sortation or generation process. Moreover, the teachings enable a convenient means for considering and arranging transport of mailings to best realize the cost savings resulting from destination entry discounts. Future exemplary implementations of the teachings may even contemplate the usage of a user friendly wizard, or question based needs analysis tool, for stepping a user easily through the destination entry and transportation options analysis and activation process.

In the previous description, numerous specific details are set forth, such as specific materials, structures, processes, etc., in order to provide a better understanding of the present subject matter. However, the present subject matter can be practiced without resorting to the details specifically set forth herein. In other instances, well-known processing techniques and structures have not been described in order not to unnecessarily obscure the present subject matter.

As shown by the detailed discussion of the examples above, many aspects of the present teachings are implemented using software programming of various computers and/or programmable control devices. Hence, many of the operations described above may be carried out by processing the mail makeup information to obtain destination entry discounts by execution of software, firmware, or microcode operating on processors or computers of any type used to provided the functionalities of the servers, client devices and/or programmed control for the various manufacturing (mail generating, handling or processing) elements shown in the system drawings. Additionally, code for implementing such operations may be in the form of computer instruction in any form (e.g. source code, object code, interpreted code, etc.) stored in or carried by any computer or machine readable medium.

Program aspects of the technology may be thought of "products," typically in the form of executable code and/or associated data that is carried on or embodied in a type of machine readable medium. Media include any or all of the memory of the computers, processors or the like, or associated modules thereof, such as various semiconductor memories, tape drives, disk drives and the like, which may provide storage at any time for the software programming. All or portions of the software may at times be communicated through the Internet or various other telecommunication networks. Such communications, for example, may enable loading of the software from one computer or processor into another. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. Terms regarding computer or machine "readable medium" (or media) as used herein therefore relate to any physical medium or transmission medium that participates in providing instructions or code or data (e.g. license records or license related information) to a processor for execution or processing. Such a medium may take many forms, including but not limited to, non-volatile media and volatile media as well as carrier wave and physical transmission media.

Only the preferred embodiments of the present subject matter and but a few examples of its versatility are shown and described in the present disclosure. It is to be understood that the present subject matter is capable of use in various other combinations and environments and is susceptible of changes and/or modifications within the scope of the inventive concept as expressed herein.

What is claimed is:

1. A method of processing a mailing including a plurality of mail articles, the method comprising steps of:

obtaining mail characteristic data associated with the mailing, the mail characteristic data being pre-processing data available before the mailing is processed on an inserter or a sorter, the mail characteristic data having a data format other than postal authority approved electronic mail formats;

determining one or more postal authority destination entry locations associated with the plurality of mail articles based on the mail characteristic data;

estimating, by a computer, a value of destination entry postage discounts associated with the plurality of mail articles based at least in part upon the one or more destination entry locations;

generating destination makeup information associated with said one or more destination entry locations, the destination makeup information including at least one of weight information of the mailing, mail article piece count and information about a number of containers for the mailing;

sending, via a network, the destination makeup information, to a transportation company; and in response to the destination makeup information, receiving, by the computer, from the transportation company via the network, delivery carrier information associated with the mailing, the delivery carrier information including at least a cost of transporting one or more of the plurality of mail articles to each destination entry location, and a plurality selected from the group consisting of truck pickup scheduling, transportation time, delivery route information, weather conditions, shipping options, comparative delivery carrier data and delivery requirement information.

2. The method of claim 1, wherein the mail characteristic data includes one or more of the following: an addressee or entity name, street name, post office box number, building name, postage or indicia marking, barcode information, weight class information, numerical ZIP Code, city, and state.

3. The method of claim 1, further comprising:

arranging transport of one or more of the plurality of mail articles to each destination entry location; and transporting one or more of the plurality of mail articles to each destination entry location.

4. The method of claim 1, further comprising a step of, after receiving delivery carrier information, inserting or sorting the mailing.

5. The method of claim 1, wherein the delivery carrier information includes at least one of transportation cost, pickup time or delivery time.

6. The method of claim 1, wherein the destination makeup information includes number and weight of containers, information about pickup location of mailing, and weight of the mailing for each destination entry location.

7. A computer system comprising:

a computer; and a non-transitory computer-readable medium storing a program configured to cause the computer to perform steps comprising:

obtaining mail characteristic data associated with the mailing, the mail characteristic data being pre-processing data available before the mailing is processed on an inserter or a sorter, the mail characteristic data having a data format other than postal authority approved electronic mail formats;

determining one or more postal authority destination entry locations associated with the plurality of mail articles based on the mail characteristic data;

estimating, by a computer, a value of destination entry postage discounts associated with the plurality of mail articles based at least in part upon the one or more destination entry locations;

generating destination makeup information associated with said one or more destination entry locations, the destination makeup information including at least one of weight information of the mailing, mail article piece count and information about a number of containers for the mailing;

sending, via a network, the destination makeup information, to a transportation company; and in response to the destination makeup information, receiving, by the computer, from the transportation company via the network, delivery carrier information associated with the mailing, the delivery carrier information including at least a cost of transporting one or more of the plurality of mail articles to each destination entry location, and a plurality selected from the group consisting of truck pickup scheduling, transportation time, delivery route information, weather conditions, shipping options, comparative delivery carrier data and delivery requirement information.

8. A software product comprising:

a non-transitory computer readable medium on which a program is recorded, wherein the program includes executable instructions that cause a computer to perform the steps comprising:

obtaining mail characteristic data associated with the mailing, the mail characteristic data being pre-processing data available before the mailing is processed on an inserter or a sorter, the mail characteristic data having a data format other than postal authority approved electronic mail formats;

determining one or more postal authority destination entry locations associated with the plurality of mail articles based on the mail characteristic data;

estimating, by a computer, a value of destination entry postage discounts associated with the plurality of mail articles based at least in part upon the one or more destination entry locations;

generating destination makeup information associated with said one or more destination entry locations, the destination makeup information including at least one of weight information of the mailing, mail article piece count and information about a number of containers for the mailing;

sending, via a network, the destination makeup information, to a transportation company; and in response to the destination makeup information, receiving, by the computer, from the transportation company via the network, delivery carrier information associated with the mailing, the delivery carrier information including at least a cost of transporting one or more of the plurality of mail articles to each destination entry location, and a plurality selected from the group consisting of truck pickup scheduling, transportation time, delivery route information, weather conditions, shipping options, comparative delivery carrier data and delivery requirement information.

9. A method of processing a mailing including a plurality of mail articles, the method comprising steps of:

providing address data associated with the mailing, the address data being pre-processing data available before the mailing is processed on an inserter or a sorter, the address data having a data format other than postal authority approved electronic mail formats;

processing the address data via an address preparation utility for generating a ZIP Code distribution listing;

determining one or more postal authority destination entry locations associated with the plurality of mail articles based on the ZIP Code distribution listing;

estimating, by a computer, a value of destination entry postage discounts associated with the plurality of mail articles based at least in part upon the one or more destination entry locations; and in response to the determination of said one or more destination entry locations associated with the address data, receiving, by the computer, from a transportation company via a network, delivery carrier information associated with the mailing, the delivery carrier information including at least a cost of transporting one or more of the plurality of mail articles to each destination entry location, and a plurality selected from the group consisting of truck pickup scheduling, transportation time, delivery route information, weather conditions, shipping options, comparative delivery carrier data and delivery requirement information.

10. The method according to claim 9, wherein the address preparation utility includes mail preparation software including one or more executable modules for performing address integrity, address validation and/or address standardization to the address data provided as input to the mail preparation software.

11. The method of claim 9, further comprising a step of, after receiving delivery carrier information, inserting or sorting the mailing.

12. The method of claim 9, further comprising:

generating destination makeup information associated with said one or more destination entry locations, the destination makeup information including at least one of weight information of the mailing, mail article piece count, and information about a number of containers; and sending, via the network, the destination makeup information, to the transportation company.

13. The method of claim 12, wherein the destination makeup information includes number and weight of containers, information about pickup location of mailing, and weight of the mailing for each destination entry location.

14. A computer system comprising:

a computer; and a non-transitory computer-readable medium storing a program configured to cause the computer to perform steps comprising:

providing address data associated with the mailing, the address data being pre-processing data available before the mailing is processed on an inserter or a sorter, the address data having a data format other than postal authority approved electronic mail formats;

processing the address data via an address preparation utility for generating a ZIP Code distribution listing;

determining one or more postal authority destination entry locations associated with the plurality of mail articles based on the ZIP Code distribution listing;

estimating, by a computer, a value of destination entry postage discounts associated with the plurality of mail articles based at least in part upon the one or more destination entry locations; and in response to the determination of said one or more destination entry locations associated with the address data, receiving, by the computer, from a transportation company via a network, delivery carrier information associated with the mailing, the delivery carrier information including at least a cost of transporting one or more of the plurality of mail articles to each destination entry location, and a plurality selected from the group consisting of truck pickup scheduling, transportation time, delivery route information, weather conditions, shipping options, comparative delivery carrier data and delivery requirement information.

15. A software product comprising:

a non-transitory computer readable medium on which a program is recorded, wherein the program includes executable instructions that cause a computer to perform steps comprising:

providing address data associated with the mailing, the address data being pre-processing data available before the mailing is processed on an inserter or a sorter, the address data having a data format other than postal authority approved electronic mail formats;

processing the address data via an address preparation utility for generating a ZIP Code distribution listing;

determining one or more postal authority destination entry locations associated with the plurality of mail articles based on the ZIP Code distribution listing;

estimating, by a computer, a value of destination entry postage discounts associated with the plurality of mail articles based at least in part upon the one or more destination entry locations; and in response to the determination of said one or more destination entry locations associated with the address data, receiving, by the computer, from a transportation company via a network, delivery carrier information associated with the mailing, the delivery carrier information including at least a cost of transporting one or more of the plurality of mail articles to each destination entry location, and a plurality selected from the group consisting of truck pickup scheduling, transportation time, delivery route information, weather conditions, shipping options, comparative delivery carrier data and delivery requirement information.

* * * * *